US005493794A

United States Patent [19]

McKenzie et al.

[11] Patent Number: 5,493,794

[45] Date of Patent: Feb. 27, 1996

[54] COMBINATION SNOWSHOE AND BINDING

[76] Inventors: Mary M. McKenzie; Sally Edwards, both of 1779 Tribute Rd., Suite B, Sacramento, Calif. 95815

[21] Appl. No.: 249,278

[22] Filed: May 25, 1994

[51] Int. Cl.[6] ..... A43B 5/04

[52] U.S. Cl. ..... 36/122; 36/124; 36/125; 36/97

[58] Field of Search ..... 36/122, 123, 124, 36/125, 97

[56] References Cited

U.S. PATENT DOCUMENTS

| | | | |
|---|---|---|---|
| 2,738,596 | 3/1956 | Walsh | 36/124 |
| 2,821,031 | 1/1958 | Howe | 36/125 |
| 3,600,829 | 4/1970 | LaViolette | 36/124 |
| 3,755,926 | 9/1973 | Schonbrun | 36/125 |
| 3,965,585 | 6/1976 | Stewart | 36/25 |
| 4,083,128 | 4/1978 | Rossman | 36/97 |
| 4,085,529 | 4/1978 | Merrif-ield | 36/125 |
| 4,161,071 | 7/1979 | Maul | 36/125 |
| 4,213,256 | 7/1980 | Mas | 36/125 |
| 4,271,609 | 6/1981 | Merrif-ield . | |
| 4,604,817 | 8/1986 | Ramboz | 36/125 |
| 4,720,927 | 1/1988 | Abegg | 36/122 |
| 4,720,928 | 1/1988 | Faber et al. | 36/125 |

OTHER PUBLICATIONS

1990 Atlas Snow–Shoe Company Trade Brochure.
1993 Northern Lites Trade Brochure.
1993 Tubbs Snowshoes Trade Brochure
1993 Injun Summer Trade Brochure.
Disclosure of Prototype sold in 1992—see enclosed page with photographs of prototype and current model as claimed in this patent application.

*Primary Examiner*—Paul T. Sewell
*Assistant Examiner*—Marie Denise Patterson
*Attorney, Agent, or Firm*—John P. Costello

[57] ABSTRACT

A combination snowshoe and binding, wherein the binding cooperates upon the snowshoe, for evenly distributing a user's weight thereupon. The binding includes an outboard half and an inboard half, the outboard half being horizontally movable upon the inboard half, in a slidable manner. The outboard half remains loosely coupled upon a pivoting member and moves freely in a horizontal direction, to accommodate the foot widths of a variety of users. The inboard half remains stationary, while in use, but can loosened, and adjusted in a horizontal direction. By moving the inboard half to a desired adjustment position, a proper positioning for evenly distributing a user's weight upon the snowshoe can be achieved. The snowshoe further includes an asymmetric frame member for allowing a user to walk with a normal stride upon a snowy surface.

5 Claims, 8 Drawing Sheets

COMBINATION SNOWSHOE AND BINDING

BACKGROUND OF THE INVENTION

1. Field of the Invention

This invention pertains generally to snowshoes and bindings and, more particularly, to a lightweight snowshoe and a corresponding binding having independently adjustable halves.

2. Description of the Background Art

The snowshoe has undertaken a slow evolution from ancient times to the present, as new designs have resulted in more comfortable and more efficient versions of this old device for snow travel. Traditional designs centered around a "tennis racquet" shape, where the "face" of the racquet was used for placing a user's foot, and the "handle" served to buoy the snowshoe upon snowy surfaces.

More recently, the advantages of positioning the foot near the inboard side of the snowshoe frame, has been explored in snowshoe design. This positioning allows the user to walk freely and comfortably, with a natural stride, while simultaneously avoiding the problem of opposing snowshoes contacting each other, upon stepping forward.

Two basic approaches for positioning a user's foot near the inboard side of a snowshoe frame have been taken: (1) mounting the binding as closely as possible to the inboard side of a snowshoe having a symmetric frame, thus causing a user's foot to be positioned as closely to the inboard side of the snowshoe frame as possible; and (2) forming the frame into an asymmetric shape, so that the foot, upon being placed in the binding, is oriented as closely to the inboard side of the frame, as possible.

While these two approaches for positioning the user's foot near the inboard side of the snowshoe frame allow for trouble-free striding, a drawback exists in that the weight of the user is shifted significantly toward the inboard side of the frame, thus resulting in the inboard side of the frame sinking beneath the snow surface to a greater degree than the outboard side of the frame. Upon sinking, the user must expend energy to right this imbalance between the inboard and outboard sides of the frame. Over short distances, this expenditure of energy can be insignificant, but over longer distances, the user can experience significant fatigue.

Other designs have attempted to achieve a more balanced weight distribution, upon the snowshoe, by employing a symmetric frame where the binding is oriented in an offset position in relation to the frame. This has generally been achieved by mounting the binding on a pivoting member having two ends extending between the inboard and outboard rails, wherein the outboard end of the pivoting member is mounted closer to the front end of the frame, than the inboard end. By placing the pivoting member in such an offset relation, the binding likewise achieves an offset relation. The superior weight distribution achieved by this design prevents the inboard side of the frame from sinking further beneath a snowy surface, than the outboard side. However, a drawback exists in that the offset orientation of the binding places the foot a greater distance from the inboard rail, which can result in a user having to adopt an unnatural stride to avoid contacting adjacent snowshoes.

It is therefore highly desirable for a snowshoe to provide the dual characteristics of: (1) positioning the foot in a balanced manner so that the inboard and outboard sides of the snowshoe contact the snow evenly and (2) positioning the foot close enough to the inboard side of the snowshoe frame so that the user can adopt a natural stride.

Additionally, it is important for a snowshoe to be combined with a comfortable, well designed binding. The earliest forms of snowshoe bindings were merely leather tongs tied around the foot and ankle, as typically seen on the "tennis racquet" variety of snow shoes, previously described. Later, bindings were typically comprised of solid platforms for positioning the foot, coupled to a pivoting member. A plurality of straps held the foot in place, upon the platform.

Additionally, some bindings have included a "shell" structure above the platform, for encasing a users foot, thereby holding the foot substantially immovable upon the platform. Some shell structures have been constructed from two separate halves which pivot outward in a vertical plane, thereby operating as a quick-release feature, if, for example, the user falls. The rigidity of the shell structure has proven to be advantageous for rendering a user's foot immovable within the binding, in relation to the remainder of the snowshoe. By rendering the foot immovable, a consistent level placement of the bottom surface of the snowshoe upon the snow, is achieved.

A drawback that has arisen in placing the foot within a rigid shell structure has been the failure of these structures to accommodate varying foot widths. As a result, excessively large feet experience a cramped feeling within the rigid shell, and small feet experience too much play within the binding, resulting in too loose a fit.

A need therefore exists for a snowshoe and binding which orients the user's foot upon the snowshoe, so that an even weight distribution is achieved, and furthermore, so that the user can walk comfortably, for long distances, with a natural stride, and little fatigue. Additionally, a need exists for a snowshoe having a binding which readily adjusts to any user's foot width and which holds the user's foot substantially immovable within the binding, so that the bottom surface of the snowshoe can approach the snow in a consistently even manner.

The foregoing discussion reflects the state of the art of which the applicant is aware and is tendered with the view toward discharging the applicant's acknowledged duty of candor in disclosing information which may be pertinent in the examination of this application. It is respectfully stipulated, however, that nothing in the foregoing discussion teaches or renders obvious, singly or when considered in combination, applicant's claimed invention.

SUMMARY OF THE INVENTION

According to the present invention, the foregoing and other objects and advantages are attained by providing a combination snowshoe and binding wherein the binding includes horizontally movable halves for readily adjusting to any user's foot width, as well as adjusting readily for achieving an even distribution of the user's weight upon the snowshoe.

The snowshoe includes a frame constructed from lightweight, metal tubing, the frame having a front end, a rear end, an inboard rail and an outboard rail, the inboard and outboard rails connecting the front and rear ends. A flotation barrier extends between the inboard and outboard rails. This flotation barrier provides a wide surface area for contacting the snow, thereby preventing the snowshoe from sinking beneath a snowy surface. The flotation barrier may be constructed from a variety of durable materials.

The binding is coupled to a pivoting member which extends between, and couples to the inboard and outboard rails. The inboard and outboard halves of the binding each include a platform for placing a foot, the bottom surface of the platform of one half communicating in a slidably overlapping manner with the top surface of the platform of the second half. The front portions of each platform are joined together by a pivoting coupling device which allows the two halves to pivot freely in a horizontal direction. A harness secures a user's foot securely upon the platforms.

In accordance with another aspect of the invention, the harness communicates with rising elements which originate from the front portions of each platform, rise up, and terminate above each platform. Typically, the harness includes a first transverse strap which communicates with each rising element. The first transverse strap is coupled securely upon anchor points positioned along the sides of each platform. The harness additionally includes a second transverse strap coupled to the rear portions of each platform, and a heel piece, for holding a user's foot securely within the confines of the binding. The cooperation of the rising elements, first transverse strap, second transverse strap, and heel piece, combine to hold a user's foot securely within the binding.

In accordance with the invention, the frame member achieves an asymmetric shape wherein the inboard rail and outboard rail are both bent vertically upward, and where the outboard rail is additionally bent horizontally. By bending the outboard rail horizontally, the front of the outboard rail, along with the front end of the frame, both attain a substantially offset positioning, in relation to the rear of the outboard rail, thereby giving the frame its distinctly asymmetric shape.

Also in accordance with the invention, a snow cleat is coupled to the bottom of the binding for providing traction upon snowy or icy surfaces. Additionally, the surfaces of the apparatus which are prone to ice build-up are protected by a durable, ice-resistant, material, which can be derived from the same material used for the flotation barrier.

A further aspect of the invention includes a rigid snow shield coupled to the front end of the frame. This snow shield provides a flotation surface similar to the flotation barrier, but additionally provides a rigid surface for pushing the snowshoe up, and through, deep snow drifts, should they be encountered.

It is an object of this invention to provide a snowshoe having an asymmetric frame which allows a user to walk with a natural stride.

A further object is to provide a snowshoe having a binding which allows a user's weight to be distributed evenly upon the snowshoe so that the bottom surface of the snowshoe will always contact the snow in an even, consistent, manner.

An additional object is to provide a snowshoe having a binding capable of comfortably accommodating a range of foot widths.

A still further object is to provide a lightweight snowshoe that is comfortable over long distances.

Still another object is to provide a snowshoe which resists significant ice build-up.

Still other objects and advantages of the snowshoe and binding described herein will become readily apparent to those skilled in this art from the following detailed description, wherein only the preferred embodiment of the snowshoe and binding have been shown and described simply by way of illustration of the best mode contemplated for carrying out the invention. As will be realized, the snowshoe and binding described herein are capable of modifications in various obvious respects, all without departing from the invention. Accordingly, the drawings and description are to be regarded as illustrative in nature and not as restrictive.

BRIEF DESCRIPTION OF THE DRAWINGS

The invention will be more fully understood by reference to the following drawings which are for illustrative purposes only.

DESCRIPTION OF THE PREFERRED EMBODIMENTS

Figure 1:
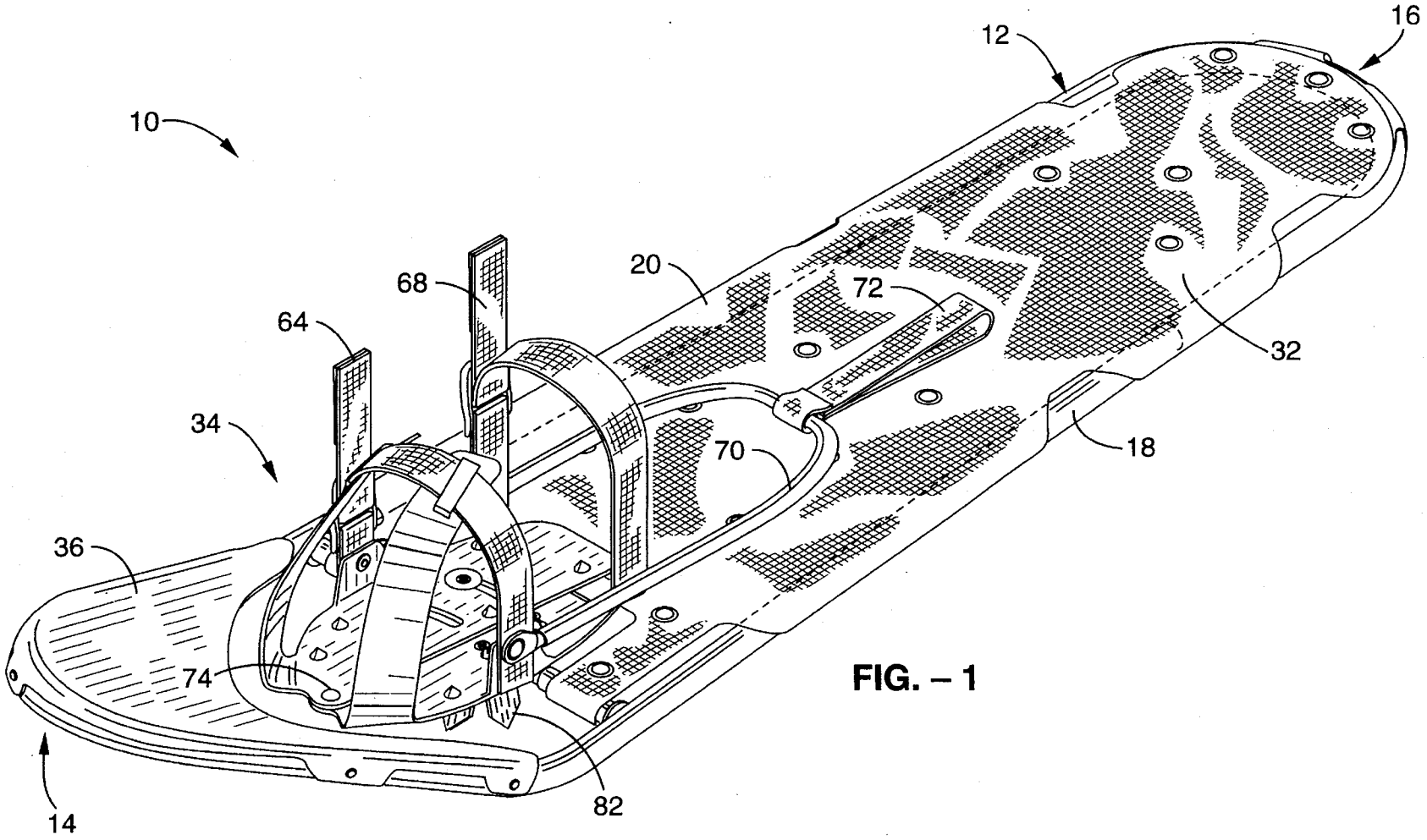
FIG. 1 is a perspective view of the snowshoe and binding of the present invention, for a right foot.
Figure 2:
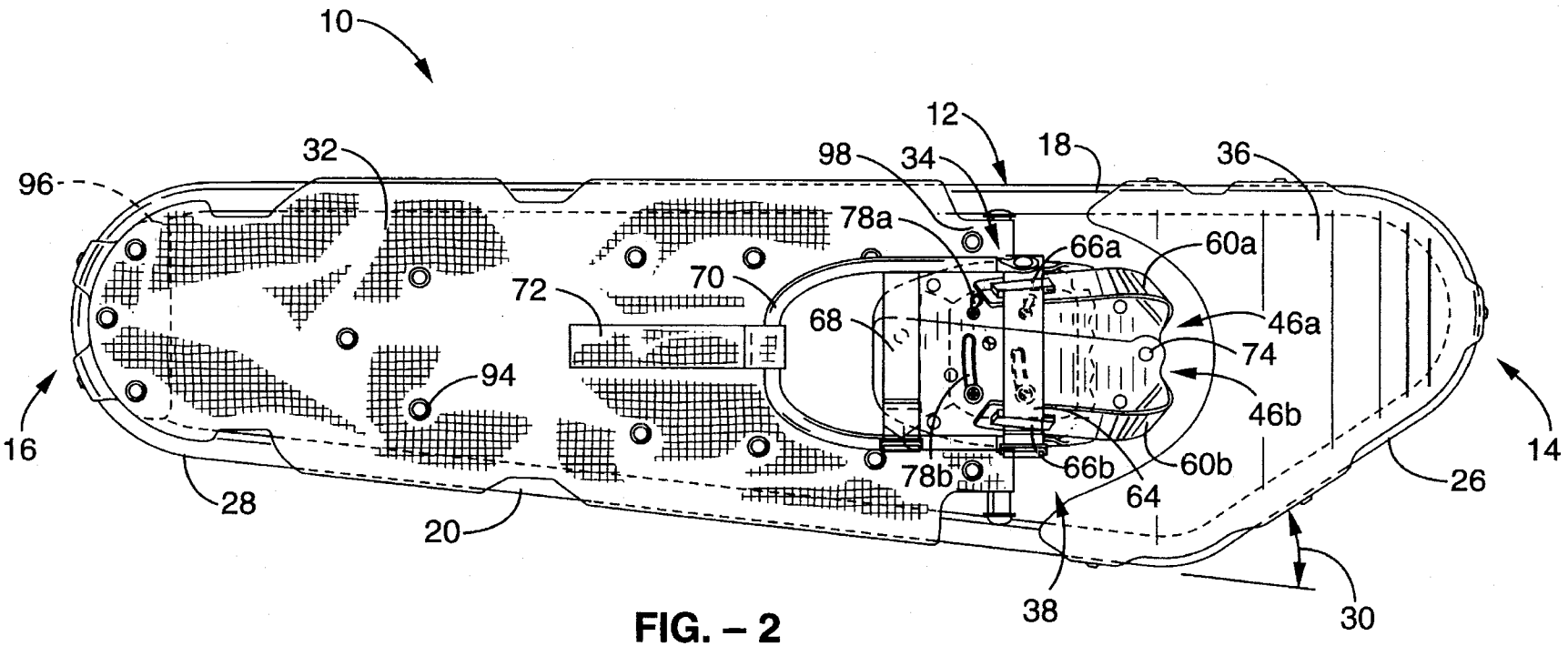
FIG. 2 is a plan view of the snowshoe and binding of FIG. 1.

Referring to FIGS. 1 and 2, the snowshoe 10 of the present invention includes an asymmetric frame generally designated 12. Asymmetric frame 12 is constructed from lightweight, non-corrosive materials, such as aluminum tubing. Frame 12 is preferably constructed from two pieces of tubing, the pieces being swaged at their adjoining ends, for a precise fit. Frame 12 includes a rounded front end 14, and a rounded rear end 16. Extending between, and joining front and rear ends are rails 18, 20, designated as inboard rail 18 and outboard rail 20, respectively. Rails 18, 20 diverge slightly from each other, as they proceed from rear end 16 to front end 14, rails 18, 20 remaining substantially linear throughout the majority of their lengths. However, upon approaching front end 14, rails 18, 20 are bent so as to give frame 12 an asymmetric shape.

Figure 3:
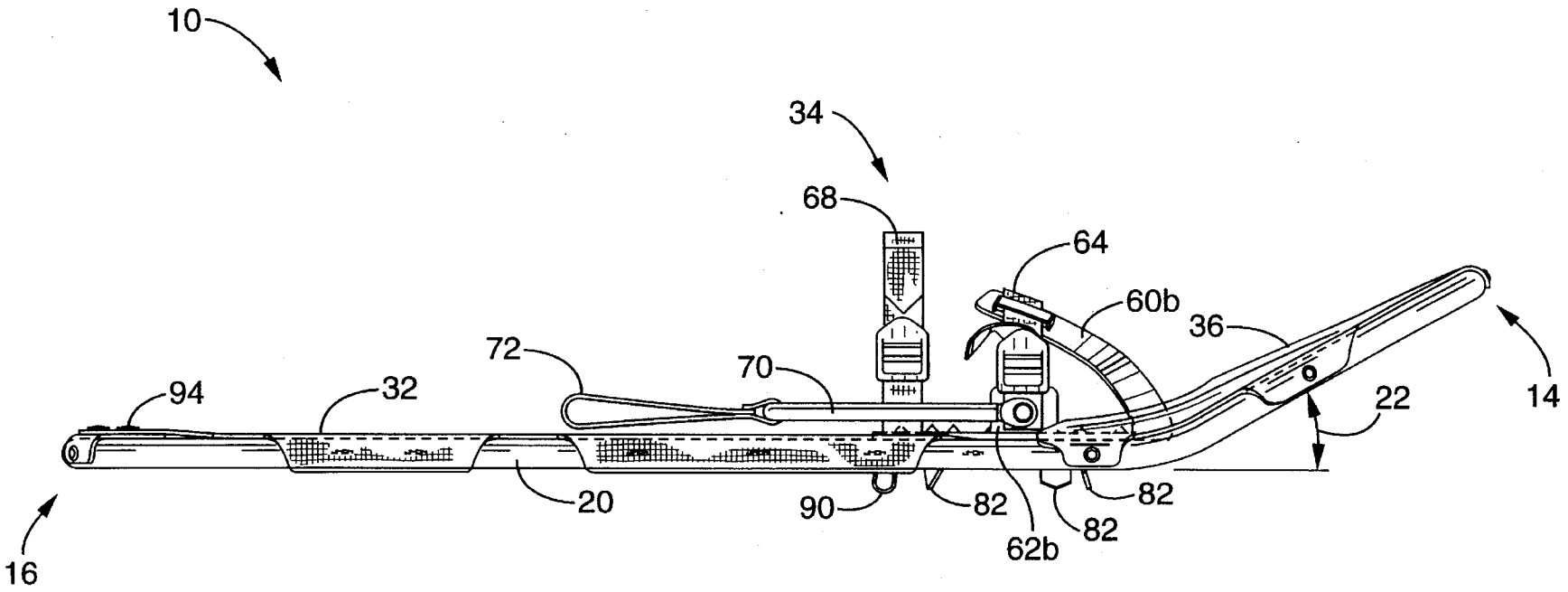
FIG. 3 is a right side elevation view of the snowshoe and binding of FIG. 1.
Figure 4:
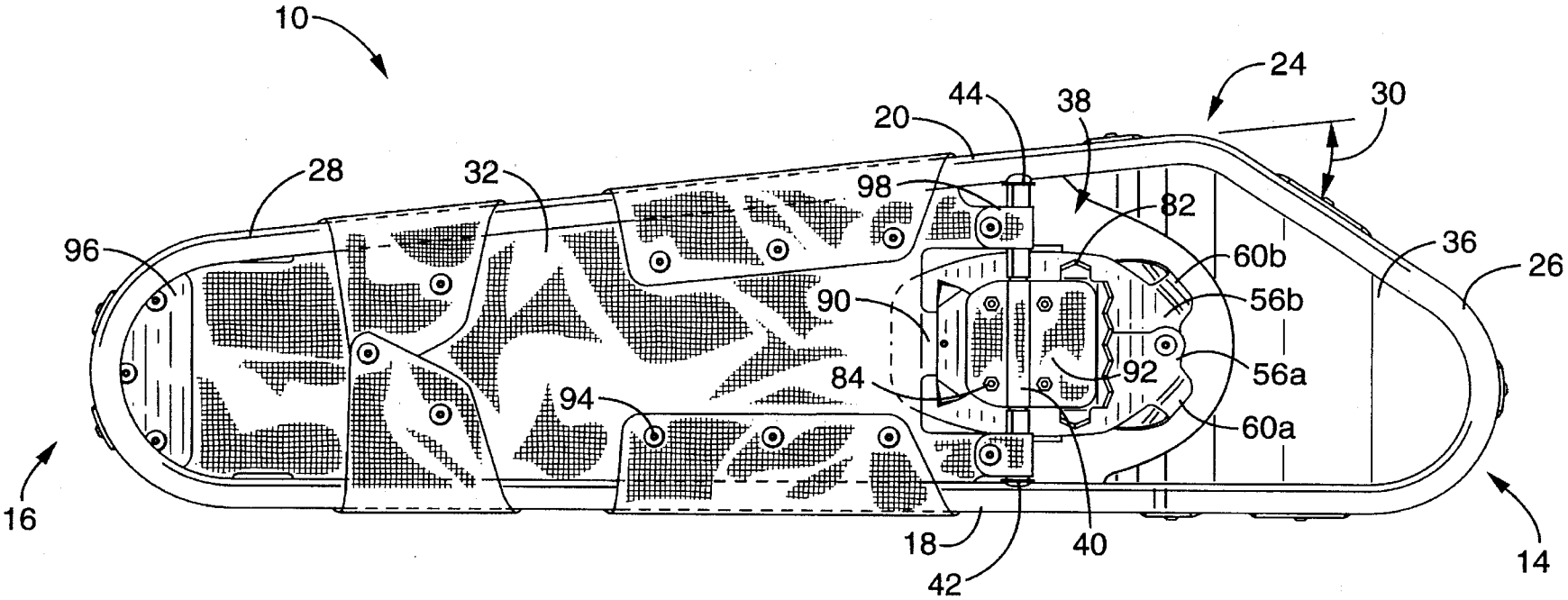
FIG. 4 is a bottom view of the snowshoe and binding of FIG. 1.
Figure 5:
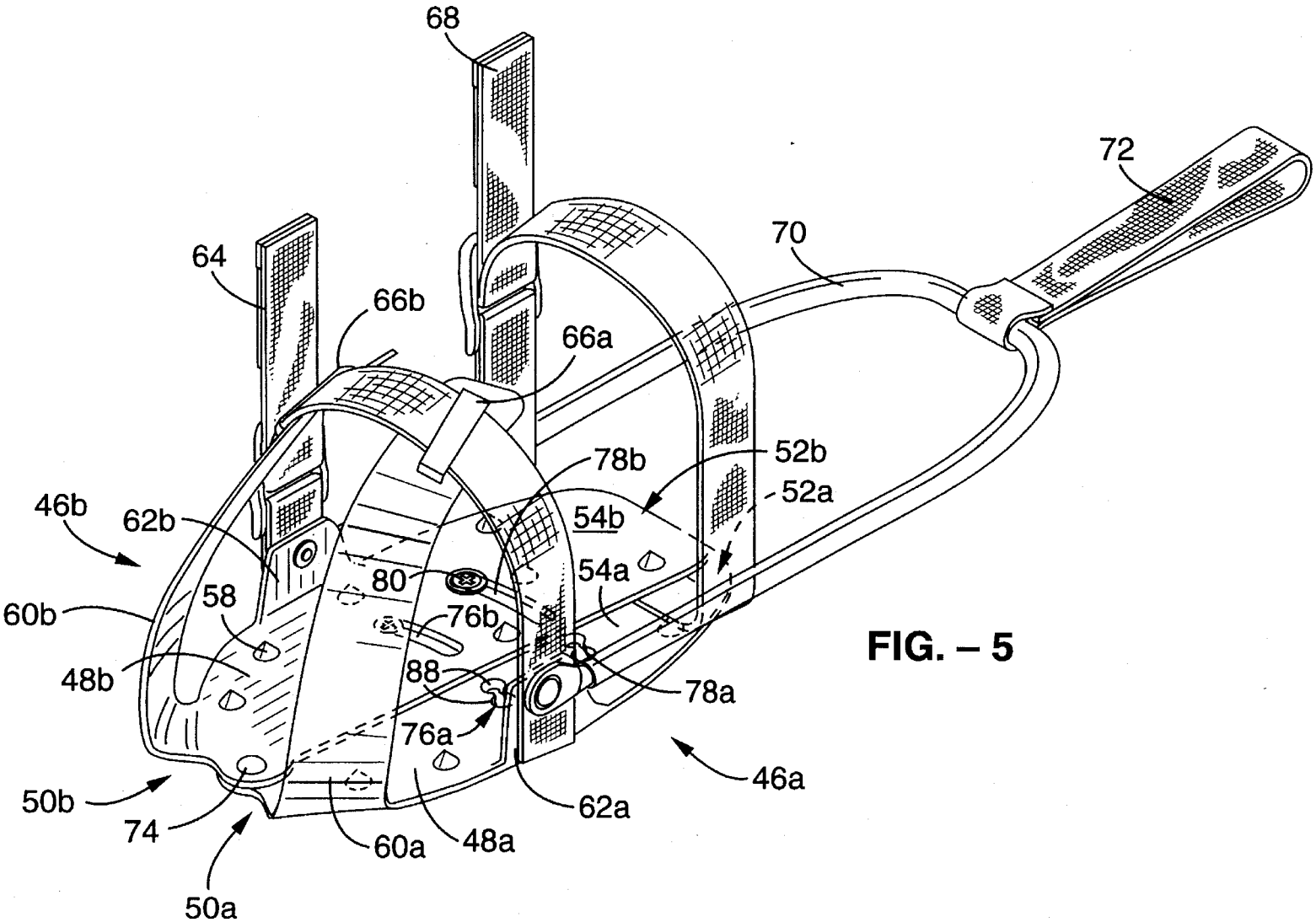
FIG. 5 is a closeup perspective view of the binding of the present invention, in the same orientation as in FIG. 1.
Figure 6:
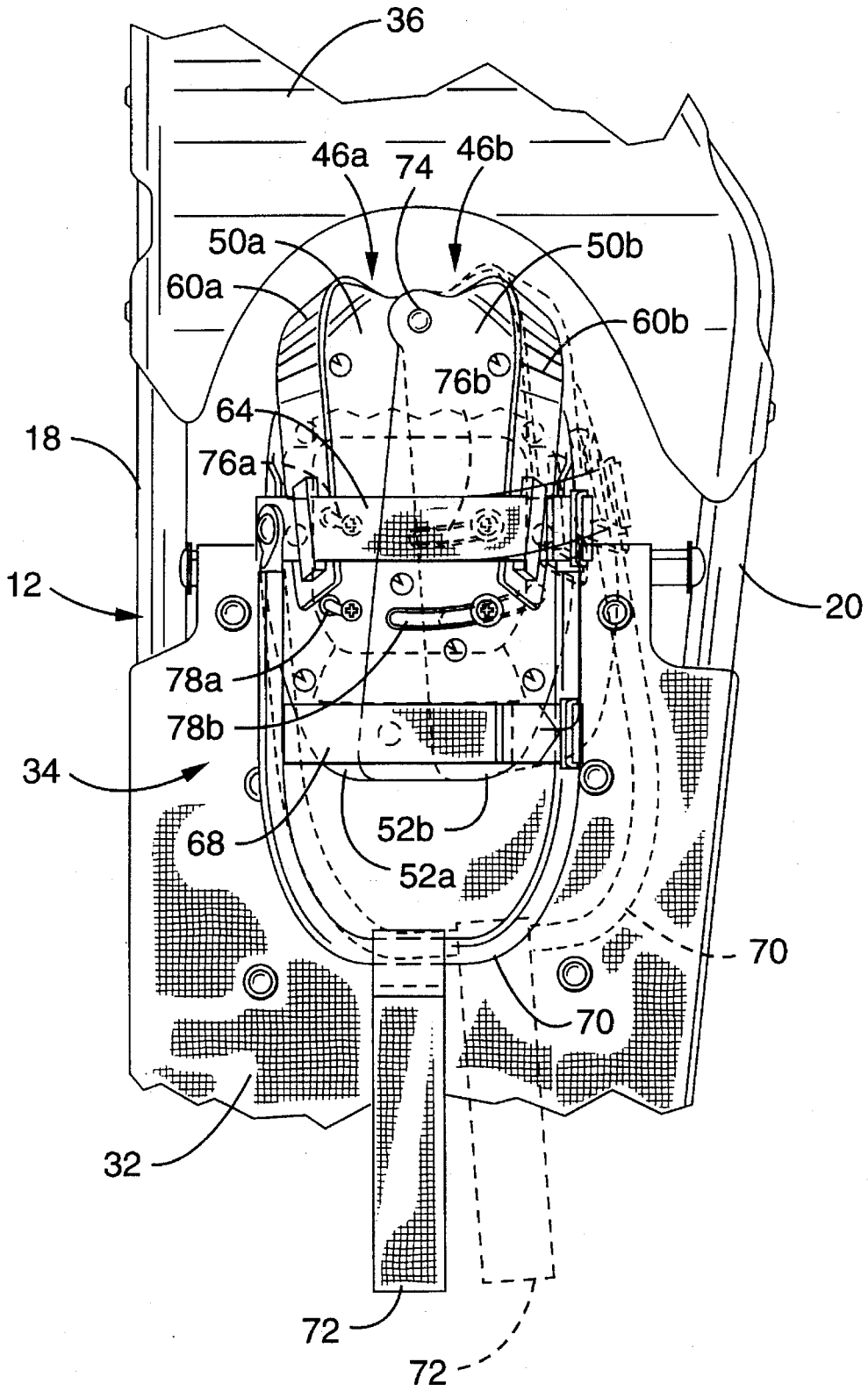
FIG. 6 is a fragmentary plan view of the binding, coupled to a portion of the snowshoe of the present invention, showing the outboard half of the binding moving in a horizontal direction.

Referring more closely to FIG. 2, FIG. 3 and FIG. 4, it can be seen how rails 18, 20 undergo a substantial upward vertical bend 22. Upward vertical bend 22 allows front end 14 to have a sufficient amount of clearance upon approaching and leaving a snowy surface. Additionally, outboard rail 20 incorporates a substantial horizontal bend 24. It is horizontal bend 24 which creates the asymmetric shape of frame 12. As a result of horizontal bend 24, front end 14 and the front portion 26 of outboard rail 20 become substantially offset from the rear portion 28 of outboard rail 20, as defined by angle 30.

An ice-resistant flotation barrier 32 extends between rails 18, 20 substantially rearward of binding 34. A snowshield 36 constructed from hard plastic, or the like, extends across front end 14, substantially front-ward of binding 34. Barrier 32 and snowshield 36 cooperate to provide a flotation surface for buoying the bottom of snowshoe 10 upon any snowy surface. Additionally, the rigid composition of snowshield 36, provides a stable surface for allowing a user to push, or plow front end 14 through deep snow drifts. Flotation barrier 32 is preferably constructed from a tear-resistant, rubber-impregnated fabric, sold under the trademark "Hypalon."

The divergence of rails 18, 20 coupled with horizontal bend 24 of outboard rail 20, create a widened area 38 between rails 18, 20. It is in this widened area 38 where binding 34 is positioned, widened area 38 allowing enough space for binding 34 to pivot freely without contacting rails 18, 20.

The geometry of asymmetric frame 12 is such that binding 34 is mounted a substantially even distance between inboard rail 18 and outboard rail 20. As a result, a user's weight placed upon binding 34 is distributed substantially evenly between the inboard 18 and outboard 20 rails. As a result of this even weight distribution, the inboard 18 and outboard 20 rails of snowshoe 10 will contact a snowy surface in an even manner.

By adjusting the geometry of frame 12 in several respects, snowshoe 10 can achieve differing performance characteristics of advantageous nature. For example, a geometry having shorter rails 18, 20, wherein the distance between rails 18, 20 is narrow, and front end 14 and front portion 26 of outboard rail 20 are offset from rear portion 28 of outboard rail 20 by a lesser angle 30, is favorable for a racing snowshoe. This type of geometry results in a shorter, narrower, lighter weight, snowshoe, perfect for racing over long distances. Alternatively, geometries having longer rails 18, 20, and a wider distance between rails 18, 20, wherein front end 14 and front portion 26 are offset from rear portion 28 of outboard rail 20 by a greater angle 30, provide a more buoyant, comfortable, snowshoe 10 for recreational use.

Referring additionally to FIG. 5, FIG. 6, and FIGS. 7A and 7B, binding 34 can be more closely examined. Binding 34 is positioned on a pivot member 40 wherein pivot member 40 has a first end 42 placed in inboard rail 18 and a second end 44 placed in outboard rail 20. Bushings 43 and 45 provide for efficient pivoting of pivot member 40. Binding 34 is comprised of an inboard half **46*a* and an outboard half 46*b*, each half further including a platform 48*a*, 48*b* having a front portion 50*a*, 50*b*, a rear portion 52*a*, 52*b*, a top surface 54*a*, 54*b* and a bottom surface 56*a*, 56*b*. Platforms 48*a*, 48*b* include a plurality of conical projections 58 which serve as a friction surface for preventing foot slippage. Rising elements 60*a*, 60*b* which are shaped approximately like the arc made by the top of the human foot, rise from a first end at front portions 50*a*, 50*b* of platforms 48*a*, 48*b* and terminate at a second end substantially above platforms 48*a*, 48*b*. Additionally, anchor points 62*a*, 62*b* are positioned along one side of each platform 48*a*, 48*b*. A first transverse strap 64 for holding a user's foot in a stationary position threads through strap guides 66*a*, 66*b* upon rising elements 60*a*, 60*b* and is coupled at each of its ends to anchor points 62*a*, 62*b*. A second transverse strap 68 couples to rear portions 52*a*, 52*b* of platforms 48*a*, 48*b* for purposes of providing a secondary means for holding a user's foot stationary within binding 34. A stretchable heel piece 70 is also coupled to anchor points 62*a*, 62*b*. Heel piece 70, upon stretching around a user's heel, provides a stable means for keeping a user's foot firmly within the confines of binding 34. Included on heel piece 70 is a pull strap 72 which allows heel piece 70** to be easily pulled around a user's heel.

Inboard **46*a* and outboard 46*b* halves are joined at front portions 50*a*, 50*b* by a pivoting coupling means 74, which allows bottom surface 56*b* of platform 48*b* of outboard half 46*b* to move horizontally across top surface 54*a* of platform 48*a* of inboard half 46*a*, in a slidably overlapping manner. Pivoting coupling means 74 causes rear portions 52*a*, 52*b* of platforms 48*a*, 48*b* to travel a greater horizontal distance than front portions 50*a*, 50*b*. For purposes of allowing a smooth top surface 54*a* on platform 48*a* for bottom surface 56*b* of platform 48*b* to slide easily upon, an area upon top surface 54*a* of inboard half 46*a* is devoid of conical projections 58**.

Hence, in the preferred embodiment, conical projections 58 are more numerous upon outboard half **46*b* than upon inboard half 46*a***.

While outboard half **46*b* is horizontally movable upon inboard half 46*a*, inboard half 46*a* remains stationary during use. In this manner, when a user places his/her foot within binding 34, inboard half 46*a* presents a stable, stationary, structure for positioning the foot for properly distributing the user's weight upon snowshoe 10. At the same time the user is positioning his/her foot within binding 34, outboard half 46*b* moves freely to accommodate any size of foot width. The horizontal movement of outboard half 46*b* is facilitated by slots 76*b*, 78*b* penetrating platform 48*b* of outboard half 46*b*. Due to the greater horizontal movement of rear portion 52*b* of outboard half 46*b* in relation to front portion 50*b*, rear slot 78*b* has a greater horizontal length than front slot 76*b*. One or more coupling devices, such as phillips-head screws 80 penetrate slots 76*b*, 78*b* and couple outboard half 46*b* loosely to snow cleat 82 using a fastening means such as nuts 84**.

The loose coupling of phillips-head screws 80 allow outboard half **46*b* to move freely in a horizontal manner upon inboard half 46*a*. Additionally, spacer 86 is positioned between platform 48*b* of outboard half 46*b* and snow cleat 82 to provide a means for elevating outboard half 46*b* a sufficient degree for allowing efficient horizontal sliding of bottom'surface 56*b* of platform 48*b* across top surface 54*a* of platform 48*a***.

While inboard half **46*a* must be set in a stationary position for purposes of properly positioning a user's foot upon snowshoe 10, inboard half 46*a* is additionally capable of being uncoupled from its stationary position and moved in a horizontal direction to one or more additional adjustment positions 88. Upon reaching a desired adjustment position 88, inboard half 46*a* may be re-coupled in a stationary manner. This capability to be moved in a horizontal direction is facilitated by similar means to that previously described for outboard half 46*b*. That is, a front slot 76*a* and a longer rear slot 78*a* are penetrated by phillips-head screws 80. However, slots 76*a*, 78*a*, unlike slots 76*b*, 78*b* in outboard half 46*b*, include adjustment positions 88 for positioning, and securely fastening, phillips head screws 80. Adjustment positions 88 may be countersunk recesses along slots 76*a*, 78*a* which allow phillips-head screws 80 to seat snugly, upon fastening platform 48*a* tightly to snowcleat 82**.

By providing inboard half **46*a* with the capability to move horizontally, exceptionally long, or wide feet, can be accommodated in the proper orientation for achieving optimum weight distribution upon snowshoe 10. For example, a user may have a long foot where his/her heel extends far enough to contact outboard rail 20. This condition can lead to improper weight distribution and also discomfort to the user each time his/her heel contacts outboard rail 20. To alleviate both problems, inboard half 46*a* can be moved in a horizontal direction toward inboard rail 18, thereby positioning both the binding 34 and the user's foot more centrally upon snowshoe 10**.

Figure 7A:
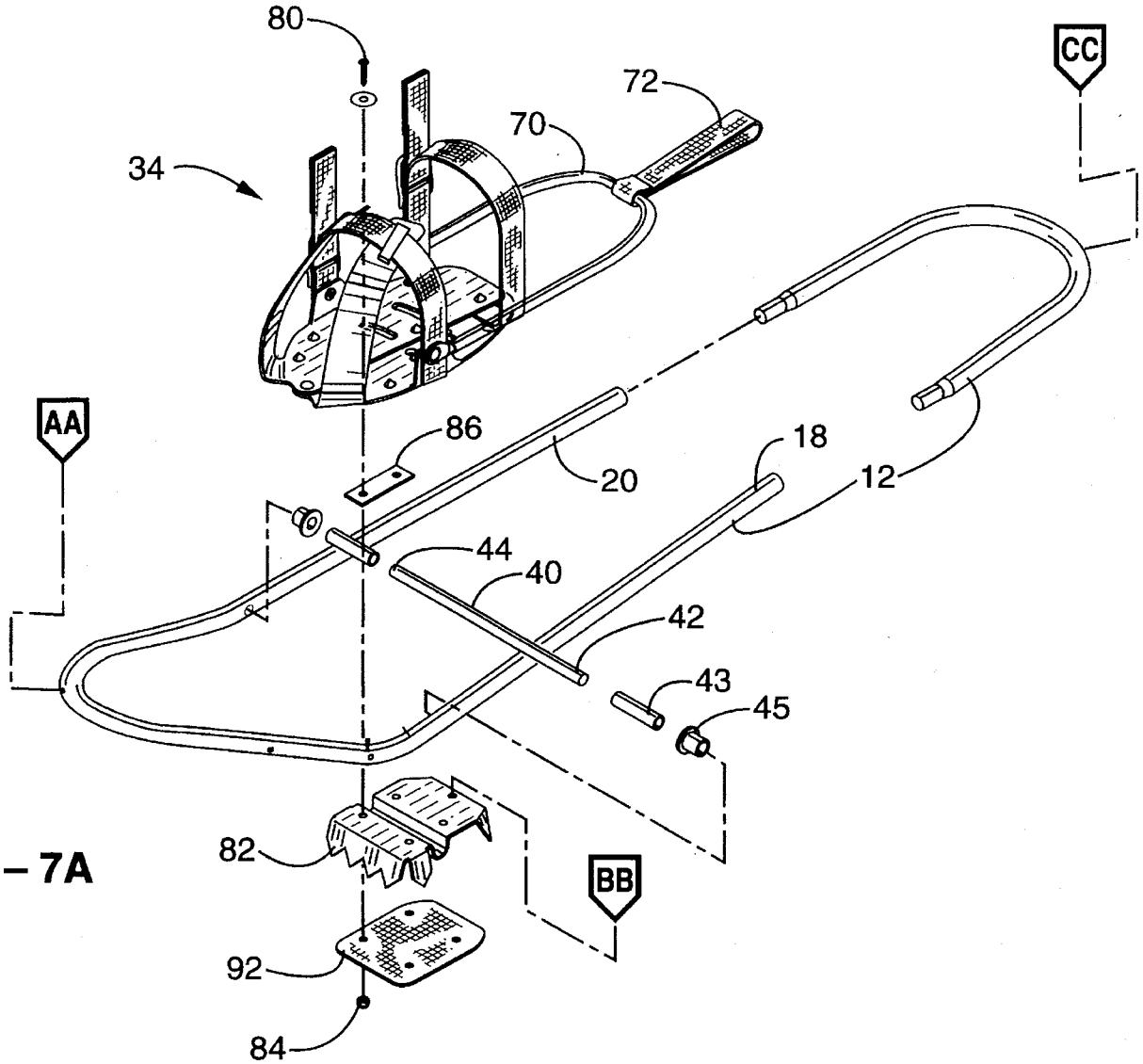
FIGS. 7A and 7B together illustrate an exploded view of the major components of the snowshoe and binding of FIG. 1.
Figure 7B:
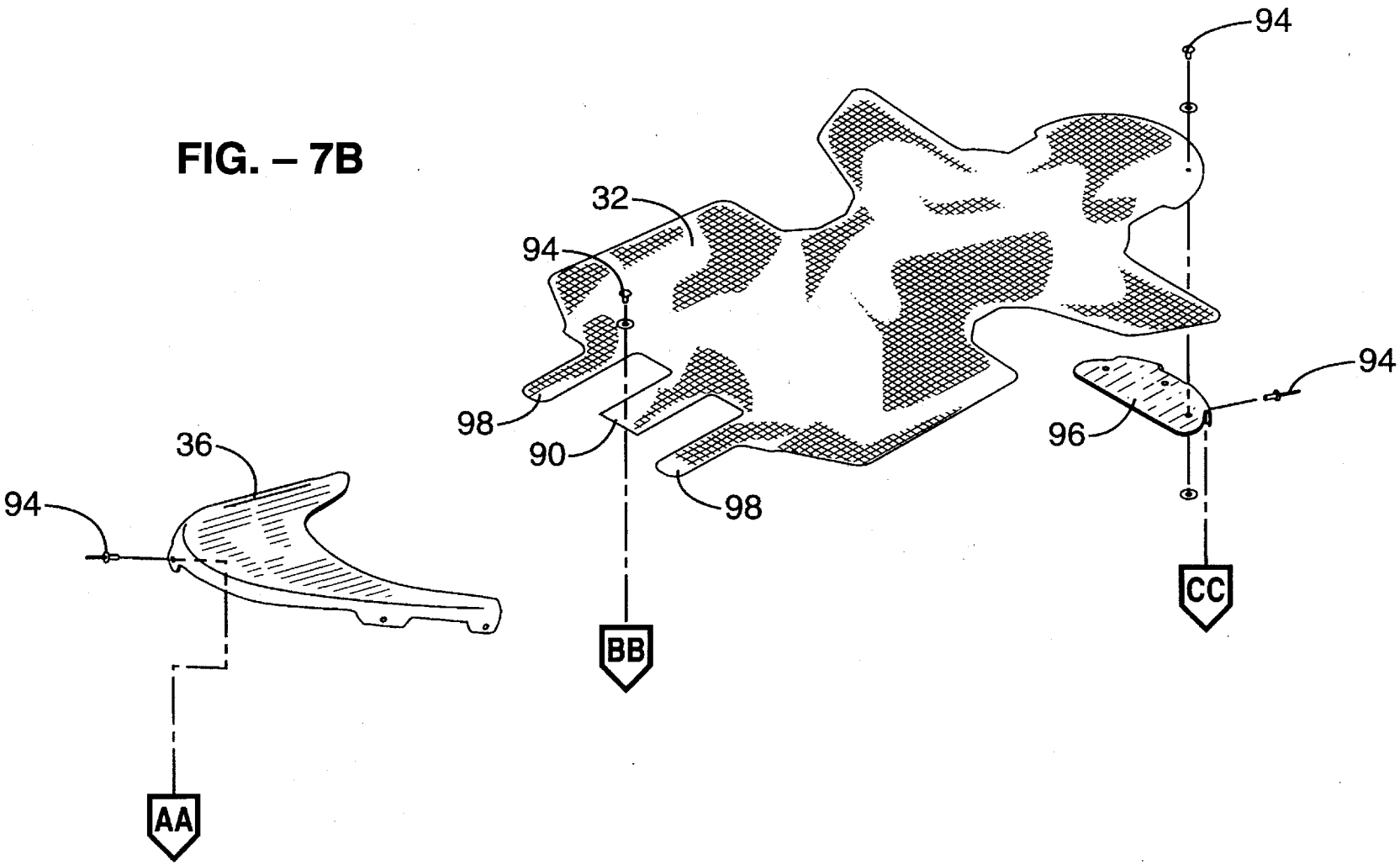

Referring closely to FIG. 4, and FIGS. 7A and 7B, the underside of snowshoe 10 can be readily examined. Snowcleat 82 couples to binding 34 by first forming around pivot member 40; coupling occurring using phillips-head screws 80 and nuts 84, as described previously. Binding 34 and snowcleat 82 rotate freely upon pivot member 40, in a vertical plane. A rotation limiter 90 for limiting the vertical rotation of snowcleat 82 and binding 34, is provided by a piece of material continuous with, and originating from, flotation barrier 32, coupled to snowcleat 82. In this way, rotation limiter 90 prevents binding 34 and snowcleat 82 from rotating too far in relation to snowshoe 10, thus avoiding placing snowshoe 10 at a disadvantageous orientation for stepping forward onto a snowy surface.

The preferred metallic composition of snowcleat 82 creates a significant problem of ice buildup. Ice freezes readily and remains on snowcleat 82, thus adding additional weight, which can cause a user to experience premature fatigue when traveling long distances, over snowy terrain. To alleviate this problem, de-icer 92, which is comprised of flotation barrier material, is preferably placed upon the exposed metallic surfaces of snowcleat 82.

Flotation barrier 32 fastens upon frame 12 by first wrapping around frame 12 and, secondly, being stretched tight and coupled upon itself using a plurality of rivets 94, or the like. A solid, rear piece 96 couples to rear end 16 of frame 12. Rear piece 96, provides a solid surface for stretching and coupling flotation barrier 32 thereto. A pair of front extensions 98 extending from flotation barrier 32 are stretched tight around pivot member 40, thus insuring that flotation barrier 32 remains taught across its entire surface.

Accordingly, it will be seen that this invention provides for a modern, lightweight, snowshoe having an asymmetric frame and a binding which first adjusts to accommodate the width of a user's foot, and secondly, adjusts for positioning a user's foot properly upon the snowshoe for optimal weight distribution. The combination of an asymmetric frame and adjustable binding provides a snowshoe and binding of high utility and comfort, making this device especially suitable for traveling long distances over snowy terrain.

Although the description above contains many specificities, these should not be construed as limiting the scope of the invention but as merely providing illustrations of some of the presently preferred embodiments of this invention. Thus the scope of this invention should be determined by the appended claims and their legal equivalents.

I claim:

1. In combination, (a) A snowshoe, comprising:

(i) A frame member, said frame member having a front end, a rear end, an inboard rail and an outboard rail, said inboard and outboard rails extending between said front and rear ends;

(ii) a rigid snowshield coupled to said front end of said frame member;

(iii) a flotation barrier, said barrier coupled between said inboard and outboard rails; and (iv) a pivot member, said pivot member having opposite ends engaging said inboard and outboard rails;

(b) a binding, coupled to said pivot member, comprising:

(i) an inboard half and an outboard half, said inboard and outboard halves each including a platform, said platform including a top and a bottom surface, a front portion, a rear portion, and sides, said bottom surface of said platform of said outboard half slidably overlapping said top surface of said platform of said inboard half;

(ii) said top surfaces of said platforms of Said inboard and outboard halves include a plurality of conical projections, said conical projections being more numerous upon said outboard half than said inboard half;

(iii) adjustment means for adjusting both said inboard and outboard halves in a horizontal direction;

(iv) pivoting coupling means for coupling said front portions of said platforms together, said coupling means allowing said rear portions of said platforms to travel a greater horizontal distance than said front portions; and (v) harness means for extending over and securing a user's foot upon said platforms of said inboard and outboard halves; and (c) snow cleat means for providing traction.

2. In combination, (a) A snowshoe, comprising:

(i) A frame member, said frame member having a front end, a rear end, an inboard rail and an outboard rail, said inboard and outboard rails extending between said front and rear ends;

(ii) a flotation barrier, said barrier coupled between said inboard and outboard rails; and (iii) a pivot member , said pivot member having opposite ends engaging said inboard and outboard rails;

(b) a binding, coupled to said pivot member, comprising:

(i) an inboard half and an outboard half, said inboard and outboard halves each including a platform, said platform including a top and a bottom surface, a front portion, a rear portion, and sides, said bottom surface of said platform of said outboard half slidably overlapping said top surface of said platform of said inboard half;

(ii) said inboard and outboard halves further including rising elements having first and second ends, said first ends originating from said front portions of said platforms, said second ends terminating substantially above said platforms;

(iii) said inboard and outboard halves further including anchor points positioned along said sides of said platforms;

(iv) adjustment means for adjusting both said inboard and outboard halves in a horizontal direction;

(v) pivoting coupling means for coupling said front portions of said platforms together, said coupling means allowing said rear portions of said platforms to travel a greater horizontal distance than said front portions; and (vi) harness means for extending over and securing a user's foot upon said platforms of said inboard and outboard halves, said harness means including a first transverse strap, a second transverse strap and a heel piece, said first transverse strap cooperating with said rising elements and being coupled to said anchor points, said heel piece also being coupled to said anchor points, said second transverse strap coupled to said rear portions of said platforms;

(c) snow cleat means for providing traction; and (d) a rigid snowshield coupled to said front end of said frame member.

3. The combination of claim 2, wherein said top surfaces of said platforms of said inboard and outboard halves include a plurality of conical projections, said conical projections being more numerous upon said outboard half than said inboard half.

4. In combination, (a) A snowshoe, comprising:

(i) An asymmetric frame member, said frame member having a front end and a rear end, said front end including a rigid snow shield coupled thereto;

(ii) said frame member further including an inboard rail and an outboard rail, said inboard and outboard rails extending between said front and rear ends;

(iii) said inboard and outboard rails diverging from each other along their lengths as said rails extend from said rear end to said front end;

(iv) said inboard and outboard rails bent upward in a vertical plane near said front end, said outboard rail further including a horizontal bend;

(v) said horizontal bend of said outboard rail causing said front end to adopt a substantially offset orientation;

(vi) a flotation barrier, said barrier coupled between said inboard and outboard rails; and (vii) a pivot member , said pivot member having opposite ends engaging said inboard and outboard rails;

(b) a binding, coupled to said pivot member, comprising:

(i) an inboard half and an outboard half, said inboard and outboard halves each including a platform, said platform including a top and a bottom surface, a front portion, a rear portion, and sides, said bottom surface of said platform of said outboard half slidably overlapping said top surface Of said platform of said inboard half;

(ii) said inboard and outboard halves further including rising elements having first and second ends, said first ends originating from said front portions of said platforms, said second ends terminating substantially above said platforms;

(iii) said inboard and outboard halves further including anchor points positioned along said sides of said platforms;

(iv) adjustment means for adjusting both said inboard and outboard halves in a horizontal direction;

(v) pivoting coupling means for coupling said front portions of said platforms together, said coupling means allowing said rear portions of said platforms to travel a greater horizontal distance than said front portions;

(vi) said top surface of said platforms including a plurality of conical projections placed thereon; and (vii) harness means for extending over and securing a user's foot upon said platforms of said inboard and outboard halves, said harness means including a first transverse strap, a second transverse strap and a heel piece, said first transverse strap cooperating with said rising elements and being coupled to said anchor points, said heel piece also being coupled to said anchor points, said second transverse strap coupled to said rear portions of said platforms;

(c) snow cleat means for providing traction; and (d) deicing means for deicing surfaces prone to ice build-up.

5. A binding, comprising:

(a) an inboard half and an outboard half, said inboard and outboard halves each including a platform, said platform including a top and a bottom surface, a front portion, a rear portion, and sides, said bottom surface of said platform of said outboard half slidably overlapping said top surface of said platform of said inboard half;

(b) said inboard and outboard halves further including rising elements having first and second ends, said first ends originating from said front portions of said platforms, said second ends terminating substantially above said platforms;

(c) said inboard and outboard halves further including anchor points positioned along said sides of said platforms;

(d) adjustment means for adjusting both said inboard and outboard halves in a horizontal direction;

(e) pivoting coupling means for coupling said front portions of said platforms together, said coupling means allowing said rear portions of said platforms to travel a greater horizontal distance than said front portions;

(f) said top surfaces of said platforms of said inboard and outboard halves including a plurality of conical projections placed thereon, said conical projections being more numerous upon said outboard half than said inboard half, said conical projections acting as a friction surface; and (g) harness means for extending over and securing a user's foot upon said platforms of said inboard and outboard halves, said harness means including a first transverse strap, a second transverse strap and a heel piece, said first transverse strap cooperating with said rising elements and being coupled to said anchor points, said heel piece also being coupled to said anchor points, said second transverse strap coupled to said rear portions of said platforms.

* * * * *